United States Patent [19]

Prough

[11] 4,071,399

[45] Jan. 31, 1978

[54] APPARATUS AND METHOD FOR THE DISPLACEMENT IMPREGNATION OF CELLULOSIC CHIPS MATERIAL

[75] Inventor: James R. Prough, Glens Falls, N.Y.

[73] Assignee: Kamyr, Inc., Glens Falls, N.Y.

[21] Appl. No.: 719,656

[22] Filed: Sept. 1, 1976

[51] Int. Cl.[2] ..... D21C 3/24; D21C 1/00; D21C 7/06; D21C 7/14

[52] U.S. Cl. ..... 162/16; 162/17; 162/18; 162/19; 162/52; 162/237; 162/246; 162/248

[58] Field of Search ..... 162/18, 19, 52, 246, 162/237, 56, 55, 16, 17, DIG. 2, 248

[56] References Cited

U.S. PATENT DOCUMENTS

| | | | |
|---|---|---|---|
| 2,359,543 | 10/1944 | Branzelle et al. | 162/237 |
| 2,459,180 | 1/1949 | Richter | 162/18 |
| 3,097,987 | 7/1963 | Sloman | 162/17 |
| 3,200,032 | 8/1965 | Richter et al. | 162/19 |
| 3,652,384 | 3/1972 | Sloman | 162/19 |
| 3,745,063 | 7/1973 | Fisher | 162/16 |
| 3,764,462 | 10/1973 | Baierl | 162/16 |
| 3,802,956 | 4/1974 | Backlund | 162/19 |
| 3,811,994 | 5/1974 | Ostberg | 162/19 |
| 3,912,579 | 10/1975 | Braun | 162/55 |

FOREIGN PATENT DOCUMENTS

| | | | |
|---|---|---|---|
| 2,361,627 | 6/1974 | Germany | 162/237 |
| 2,439,077 | 3/1975 | Germany | 162/237 |

*Primary Examiner*—S. Leon Bashore
*Assistant Examiner*—Steve Alvo
*Attorney, Agent, or Firm*—Cushman, Darby & Cushman

[57] ABSTRACT

An apparatus and method for the displacement impregnation of cellulosic chips material with digesting liquid. Cellulosic chips material and liquid are fed from a source to a high pressure transfer valve whereat the pressure of the chips and liquid is boosted. The chips are fed from the high pressure transfer valve through a feed system to the topmost portion of a vertical treatment vessel, the vessel having a topmost portion and an impregnation zone in an upper portion thereof below the topmost portion. A countercurrent flow of digesting liquid in the vessel impregnation zone is established to impregnate the chips material with digesting liquid, and displace the water and minerals therefrom, and liquid withdrawn from the top of the treatment vessel is withdrawn into the feed system. The withdrawals insure that essentially no free water enters the impregnation zone. A chips plug is established at the vessel top through which all withdrawn liquid must pass. Digesting liquid may be supplied to an end portion of the high pressure treatment valve for maintaining the pH of liquid around the high pressure transfer valve at 8 or above.

15 Claims, 3 Drawing Figures

APPARATUS AND METHOD FOR THE DISPLACEMENT IMPREGNATION OF CELLULOSIC CHIPS MATERIAL

BACKGROUND AND SUMMARY OF THE INVENTION

The invention relates to an apparatus and method for the displacement impregnation of cellulosic chips material with digesting liquid. By effecting displacement impregnation of cellulosic ships material according to the present invention, the energy consumption during digestion is greatly reduced over prior art practices, the amount of scaling is reduced, the amount of turpentine and methanol that can be economically recovered is enhanced, and chemical use can be reduced.

According to the present invention, countercurrent impregnation is established in the impregnation zone of a treatment vessel and moisture, calcium, and other materials displaced from chips material in the impregnation zone are withdrawn through the topmost portion of the treatment vessel, into the feed system for the vessel. This is distinct from the prior art, as exemplified by U.S. Pat. Nos. 3,802,956 and 3,097,987, wherein there is no liquid withdrawal into the feed system, and wherein only partial displacement impregnation takes place. In U.S. Pat. No. 3,097,987, only liquid displaced from the introduced chips liquid mixture is separated through outlet 45, the impregnation taking place cocurrently and the impregnation liquid being removed through outlet 21. Even in the pre-hydrolysis embodiment thereof, (FIG. 2), liquid is withdrawn through the outlet 47 after some countercurrent flow in zone 10, and no liquid is withdrawn from the impregnation zone through the outlet 45 at the top of the treatment vessel into the feed system, as according to the present invention. In U.S. Pat. No. 3,802,956, liquid is withdrawn from the impregnation zone through screens 28, and usually only liquid separated from the transport system is separated through strainer girdle 25. Even if the strainer 28 is eliminated, the liquid is withdrawn through line 30, and not the feed system. Additionally, according to the present invention, a chips plug is established at the top of the treatment vessel above the level of the chips column in the vessel, the chips plug isolating the feeder from the impregnation zone and providing for straining of all of the liquid being withdrawn from the vessel to keep some products that are separated from the chips within the impregnation zone so that they do not contaminate the feed system.

Displacement impregnation according to the present invention has many advantages over the prior art devices; as mentioned above, energy consumption is reduced, scaling is reduced, chemical use is reduced, and the amount of turpentine and methanol recovered is increased. By displacing all of the water in the chips before the chips enter the cooking zone, according to the present invention the "cold" associated therewith is also displaced. The water essentially never enters the cooking zone, but rather is withdrawn through the feed system, and the energy requirements for digesting the chips are thus greatly reduced. At the same percentage chemical application, the concentration is increased according to the invention over the prior art, since the water in the chips is displaced and, therefore, the cooking temperature can be reduced with equal treatment. Also, since no strainers are provided that can clog and provide "channeling" in the impregnation zone, the treatment is completely uniform (all the withdrawn liquid passes through the chips plug at the top of the treatment vessel). The mass of the chips is reduced, since the water is displaced before reaching the cooking zone, therefore, the exothermic heat from the digestion reactions provides a greater percentage of the energy requirements for digestion.

Along with the displaced water from the chips goes calcium other minerals, the calcium and other minerals being displaced before the chips enter the high temperatures of the cooking zone (and, as mentioned above, the temperatures of the cooking zone may be less). Since the calcium has a tendency to react with the carbonate in the white liquor at the high temperatures in the digestion zone with resulting scaling of the screens, heaters, etc., therein with less calcium and the like present in the cooking zone, the scaling is reduced. Also, since the extraction is in the feed system, the methanol and turpentine can be removed from lines operatively connected to the feed system with a resulting higher percentage recovery (since black liquor, with high solids content is not separated therewith). The turpentine is separated by a conventional turpentine decanter, while the methanol is separated by a conventional fractional distillation tower. Also, if sand is present in the feed system it can be removed without ever having entered the actual treatment parts of the treatment vessel.

Since the removal of many minerals, etc. takes place in the feed system, the pH of the feed system may reach a level where resin build up and the like takes place in the component parts. This may be avoided according to the present invention by taking white liquor and feeding it into the end bell portions of the high pressure feeder. Also, according to the present invention, the displaced liquid can be utilized in other portions of the digestion system, resulting in a savings in ultimate material usage.

While according to the present invention, the impregnation zone can be in a separate vessel and connected to a digester through a vapor zone (as in the U.S. Pat. No. 3,802,956), it is preferred that there be a hydraulic connection between the cooking and impregnation zones, whether they be in separate hydaulically connected vessels, or in the same vessel. This allows liquid from the cooking zone to be drawn into the impregnation zone as needed, and thus more digesting liquid can be added than is displaced, and a better control of the treatment processes is effected.

According to the present invention, apparatus for treating cellulosic chips material is provided comprising a source of cellulosic chips material and liquid, a high-pressure transfer valve for transporting the cellulosic chips and liquid under pressure, and a high pressure vertical treatment vessel having at least an impregnation zone in an upper portion thereof, and a topmost portion above the impregnation zone. A chips and liquid inlet to the vessel and a liquid withdrawal outlet from the vessel are provided in the topmost portion of the vessel, connected up to a feed system from and to the high-pressure transfer valve. Means are also provided for establishing a countercurrent flow of digesting liquid in the impregnation zone of the vessel for impregnation of the chips material therein with digesting liquid, said means including means for withdrawing liquid from the impregnation zone through the topmost portion of the vessel into the feed system. Means are provided at the bottom of the vessel for withdrawing treated chips material. Means are provided for establishing a chips plug in the vessel below the inlet and outlet, and such means for establishing a chips plug for isolation of the topmost portion may include a screw feeder rotatable about a vertical axis and surrounded by a tubular screen, the inlet to the topmost portion of the vessel being inside the tubular screen, and the outlet from the topmost portion of the vessel being outside the tubular screen, and a solid wall, generally tubular member, extending downwardly from the bottom of the screw feeder and said tubular screen for capturing chips therein and forming the chips plug. Digestion and washing may also take place in the same vessel in which the impregnation zone is located, or impregnation may take place in a separate vessel connected hydraulically to one or more other vessels for digestion and washing of the chips. Means may be provided for feeding digesting liquid to an end portion of the high pressure transfer valve for maintaining the pH of the liquid surrounding the valve at 8 or above.

According to the method of the present invention, utilizing a high pressure transfer valve and at least one vertical treatment vessel having a topmost portion and an impregnation zone in an upper portion thereof below the topmost portion, a source of cellulosic chips material and liquid is established, and the chips material and liquid are fed to the high pressure valve to boost the pressure thereof. The high pressure chips material and liquid are — through a feed system — transported to the topmost portion of the vertical treatment vessel and introduced into the topmost portion thereof, while at the same time, liquid separated from the chips is withdrawn from the impregnation zone into the topmost portion of the vessel into the feed system.

A chips plug is established at the topmost portion of the vessel below the withdrawal point of liquid therefrom and below the inlet of the chips thereto, the chips plug providing isolation of the topmost portion of the vessel from the impregnation zone.

A countercurrent flow of digesting liquid is established in the vessel impregnation zone to displace the minerals and water from the chips material and impregnate them with digesting liquid, and treated chips material is withdrawn from the bottom of the vessel. Sand may be separated from liquid in a line operatively connected to the high-pressure transfer valve by high efficiency centrifuging thereof.

It is the primary object of the present invention to provide a method and apparatus for the displacement impregnation of chips material, reduced energy requirements and scaling, and eliminate other problems encountered in prior art apparatus. This and other objects of the invention will become clear from an inspection of the detailed description of the invention and from the appended claims.

DETAILED DESCRIPTION OF THE INVENTION

Figure 1:
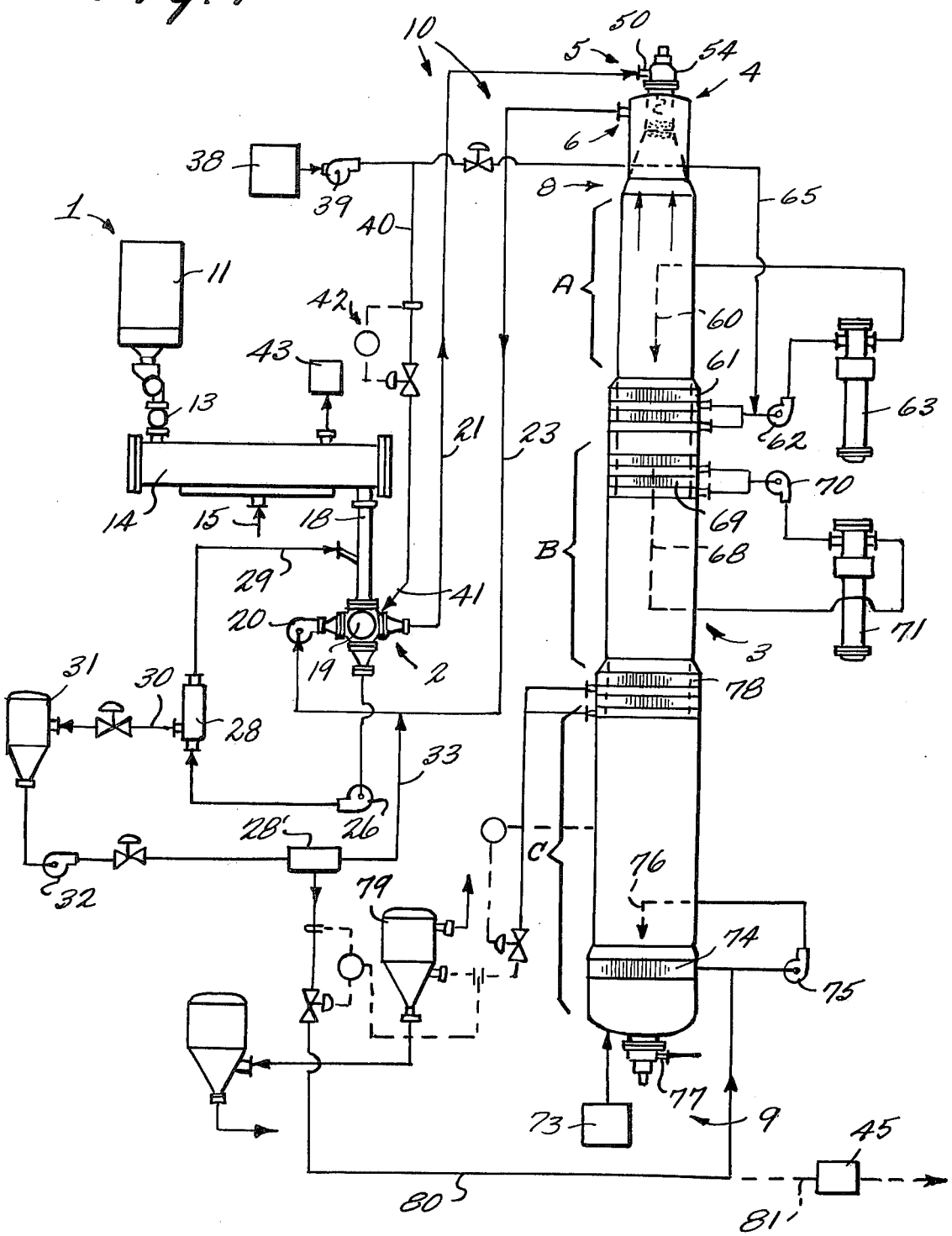
FIG. 1 is a schematic view of an exemplary one vessel embodiment of apparatus according to the present invention.

Exemplary apparatus according to the present invention includes a source 1 of cellulosic chips material and liquid, a high-pressure transfer valve 2 for transporting said cellulosic chips and liquid under pressure through a feed system 10, a high-pressure vertical treatment vessel 3 having at least an impregnation zone A in an upper portion thereof, and a top chamber (or topmost portion) 4 above the impregnation zone A, a chips and liquid inlet 5 to the vessel 3 in the topmost portion 4 thereof, a means 7 for establishing a chips plug in the vessel below the inlet 5 and outlet 6 the chips plug for isolation of the topmost portion 4 of the vessel from the impregnation zone A thereof, means 8 for establishing a countercurrent flow of digesting liquid in the impregnation zone A of the vessel 3 for displacement of the water and mineral from the chips material and the replacement thereof with digesting liquid (the means 8 are more fully described hereinafter), including means (outlet 6) for withdrawing liquid from the impregnation zone A into the feed system 10, and means 9 for withdrawing treated chips material from the bottom of the vessel 3.

The source 1 of cellulosic chips material and liquid generally comprises a chips bin 11. The chips material and liquid are fed through a rotary low-pressure valve 13 to a conventional steaming vessel 14, a conduit 15 for supplying low-pressure steam (e.g., 1 atmosphere over pressure) to the vessel 14, and a conduit 17 through which driven off gases during steaming may flow, are provided. From the steaming vessel 14, the cellulosic chips material leads to a conduit 18, digesting liquid being supplied to the fiber material in the conduit 18. The high-pressure transfer valve 2 may comprise a conventional Kamyr high-pressure transfer valve 19 having a rotor with pockets therein turning in a stationary casing to provide boosting of the pressure of the flow in which the chips are entrained. A certain amount of leakage is necessarily provided around the conventional transfer valve 19, and the rotary portion thereof tapered for automatic adjustment of the clearances if wear should occur. Circulating liquid pressurized by the pump 20 entrains the chips material in the transfer valve 19 and the chips material and liquid as forced under pressure through conduit 21 of feed system 10 through the top portion 4 of the treatment vessel 3, the line 21 leading to chips and liquid inlet 5 in the topmost portion 4 of vessel 3. A line 23 of feed system 10 leads from the liquid outlet 6 in the topmost portion 4 back to the pump 20. A pump 26 is disposed in the low pressure line leading from transfer valve 19 back through an in-line strainer 28 to line 29 which feeds liquid to the conduit 18. A portion of the liquid flowing in this loop is removed by the in-line strainer 28 through conduit 30 to a level tank 31, and from the level tank 31 is withdrawn by pump 32 to line 33, which communicates with line 23 leading from the treatment vessel 3. A second strainer 28', or a centrifugal separator comprising means for removing liquid from the feed system 10, is provided in the line 33, and water removed therefrom is passed through line 80 and may be utilized in washing in the treatment vessel 3, or used elsewhere in the mill, being passed through line 81 (shown in dotted line in FIG. 1).

In situations where a large amount of sand is present in the chips source 1, means may be provided for removing the sand from the chips and liquid, and a good place for positioning of the sand removal means is in the line 33, in place of strainer 28'. The sand removal means may comprise a high efficiency centrifugal separator, the withdrawn sand passing with liquid into line 80, while the remaining liquid is fed back into line 33. In such a situation, line 80 would not be passed back to the wash system for vessel 3, but rather would be connected to line 81. The high efficiency separator utilized for sand separation is preferably lined with ceramic. The sand separation will reduce the wear rate of the high-pressure feeder 19 in addition to providing a higher quality end product.

Apparatus may also be provided operatively associated with the line 23 for the removal of turpentine and methanol from the liquid withdrawn through liquid outlet 6, turpentine and methanol being present in the withdrawn liquid because of the displacement impregnation according to the present invention. The percentage product actually recoverable in this manner is much higher than in conventional installations, since no black liquor (with heavy solids concentration) is present in the system from which the methanol and turpentine are removed. The turpentine is removed by a conventional turpentine decanter 43 or the like in line 17. Turpentine in the liquid flowing through line 23 goes through feeder 19, and a portion is withdrawn into low-pressure line 29. That portion in line 29 flashes, since the pressure in line 29 and conduit 18 is about atmospheric pressure, and since the temperature is higher than the flash point of turpentine. The flashed turpentine then passes upwardly into presteaming vessel 14, and subsequently into conduit 17. Methanol is removed from the line 81 by a conventional distillation tower 45 or the like.

Also, in order to control the pH at the high pressure transfer valve 19, while additionally supplying digesting liquor to the means 8 for establishing a counterflow of digesting liquid in the impregnation zone A, a source 38 of digesting (white liquor) is provided. A pump 39 withdraws liquid from the source 38 and passes it from line 40 to an inlet 41 at an end portion of the high-pressure transfer valve 19. The liquid is fed to an end bell portion of the conventional Kamyr high-pressure treatment valve 19 between the stationary casing and the rotating pocketed member at an area of leakage of liquid in the valve, and the digesting liquid maintains the liquid in the area around the valve 19 basic — that is, at a pH 8 or above. In this way, build-up of pitch and resin at the high-pressure feeder 19 is avoided.

Figure 3:
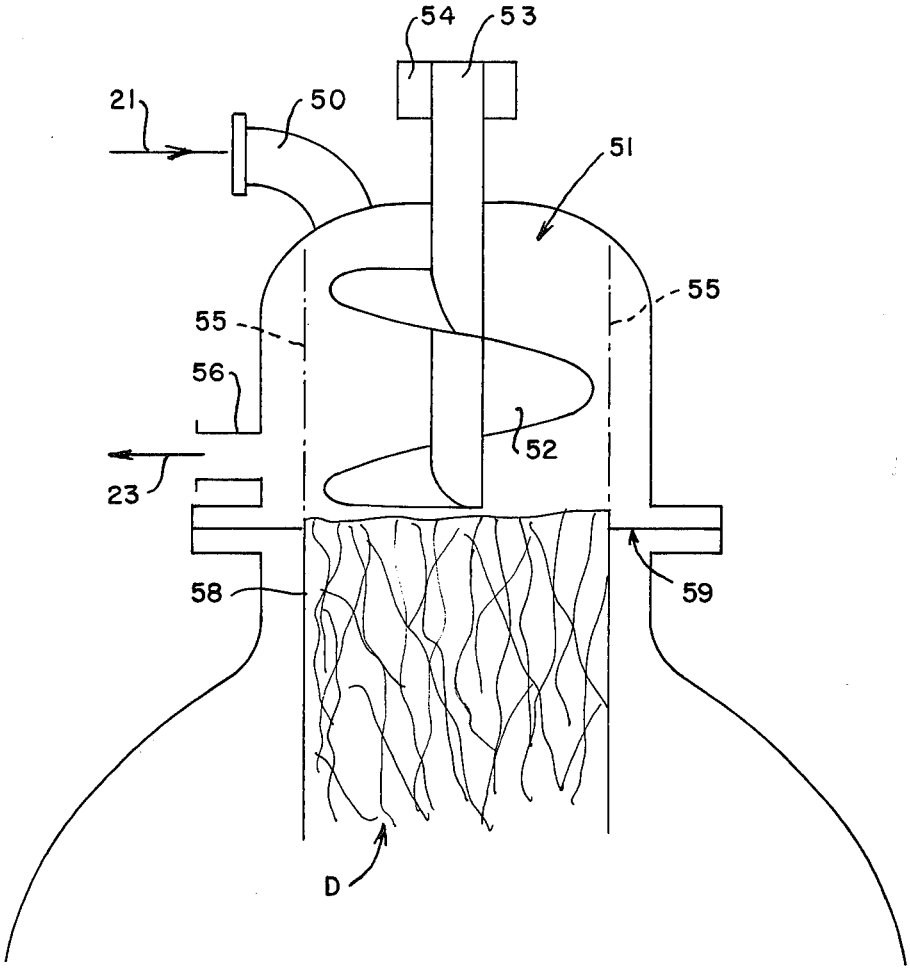
FIG. 3 is a detail schematic view of apparatus for establishing a chips plug in a treatment vessel topmost portion according to the present invention.

The means 7 for establishing a chips plug in the vessel 3 is shown in detail in FIG. 3 in conjunction with the inlet 5 and outlet 6 from the topmost portion 4 of the vessel 3. The inlet 5 includes an inlet pipe 50 leading to a chamber 51 having a right rotatable (above a vertical axis) feed screw 52 therein. As shaft 53 mounting feed screw 52 is rotated by conventional drive means 54, chips are fed from the inlet 50 downwardly toward the impregnation zone A of the treatment vessel 3. The screw-feeder 52 is surrounded by a tubular screen 55, and an outlet pipe 56 forming the outlet 6 is provided exterior of the screen 55 — while the inlet 50 is provided interiorly of the screen 55. It will thus be seen that chips are fed downwardly by the screw 52 as the liquid is withdrawn therefrom through screen 55 to outlet pipe 56. According to the present invention, a solid wall, generally tubular member 58 extends downwardly from the tubular screen 55 past the bottom of the screw-feeder 52. A plate 59 extending horizontally across the topmost portion 4 of the vessel 3 exteriorly of the solid wall, generally tubular member 58 separates the interior vessel 3 from the topmost portion 4, so that the only path liquid may take in flowing through the screen 55 to the outlet 56 from the interior of the vessel 3 is through the chips plug D established in the solid wall generally tubular member 58. The chips plug D established in the member 58 essentially acts as a screen and as an isolation device, screening out solids and viscous materials flowing upwardly in the treatment vessel 3 with the countercurrent flow of digesting liquid therein, and providing temperature isolation of the screw 52 from the vessel 3. The plug of chips D provides an ideal isolation, while still allowing flow of liquid into the outlet 56 to be withdrawn from the vessel 3. Turpentine and methanol are two liquids that commonly are withdrawn through pipe 56 when the apparatus according to the present invention is provided, and these may be separated out, as previously described above. Of course, the individual chips forming the chips plug D constantly change, as new chips are continuously fed by the screw-feeder 52 downwardly into the treatment vessel 3, individual chips in the plug D moving downwardly until eventually they pass the bottom of the member 58 and fall into the treatment vesel 3 to establish a fiber column therein.

When only a single treatment vessel 3 — as shown in FIG. 1 — is provided for the impregnation, digestion and washing of the fiber material to be treated, the means 8 for establishing a countercurrent flow of digesting liquid in the impregnation zone A of the vessel for displacement of water and minerals from the chips and replacement thereof with digesting liquid, preferably includes a conventional inlet pipe 60, screen 61, a pump 62, a heater 63, and an inlet line 65 for digesting liquid communicating with the source 38, in addition to the withdrawal outlet 6 into the feed system 10. In the digestion zone B, a conventional inlet pipe 68 is provided for introducing recirculated digesting liquid into zone B, withdrawal of digesting liquid from the zone B being affected by screen 69 and pump 70, and the withdrawn liquid being circulated through heater 71 to the desired cooking temperatures before introduction through pipe 68. At the bottom of the cooking zone B, and at the top of the washing zone C, withdrawal screens 78 are provided. The pressure in the vessel 3 is controlled by the extraction through screen 78 being adjusted in dependence upon the chip feed, moisture (wet or dry chips), condensation, white liquor addition, or first extraction. A screen 74 is provided at the bottom of washing zone C for withdrawing liquid therefrom by a pump 75, and reintroducing the washing liquid at inlet 76. Fresh wash liquid is introduced into the wash zone C through conventional supply 73 of wash liquid.

The extraction through line 80, withdrawing liquid from the feed system 10, is adjusted to provide the desired upflow impregnation and cooking zones A and B, respectively, the adjustment depending upon the product quality yield, and the energy requirements. The means 9 for withdrawing treated chips material from the bottom of the vessel 3 preferably includes a conventional withdrawal outlet 77, and a scraper may be provided in the bottom of the vessel 3 to assist in the treated chips material withdrawal.

Figure 2:
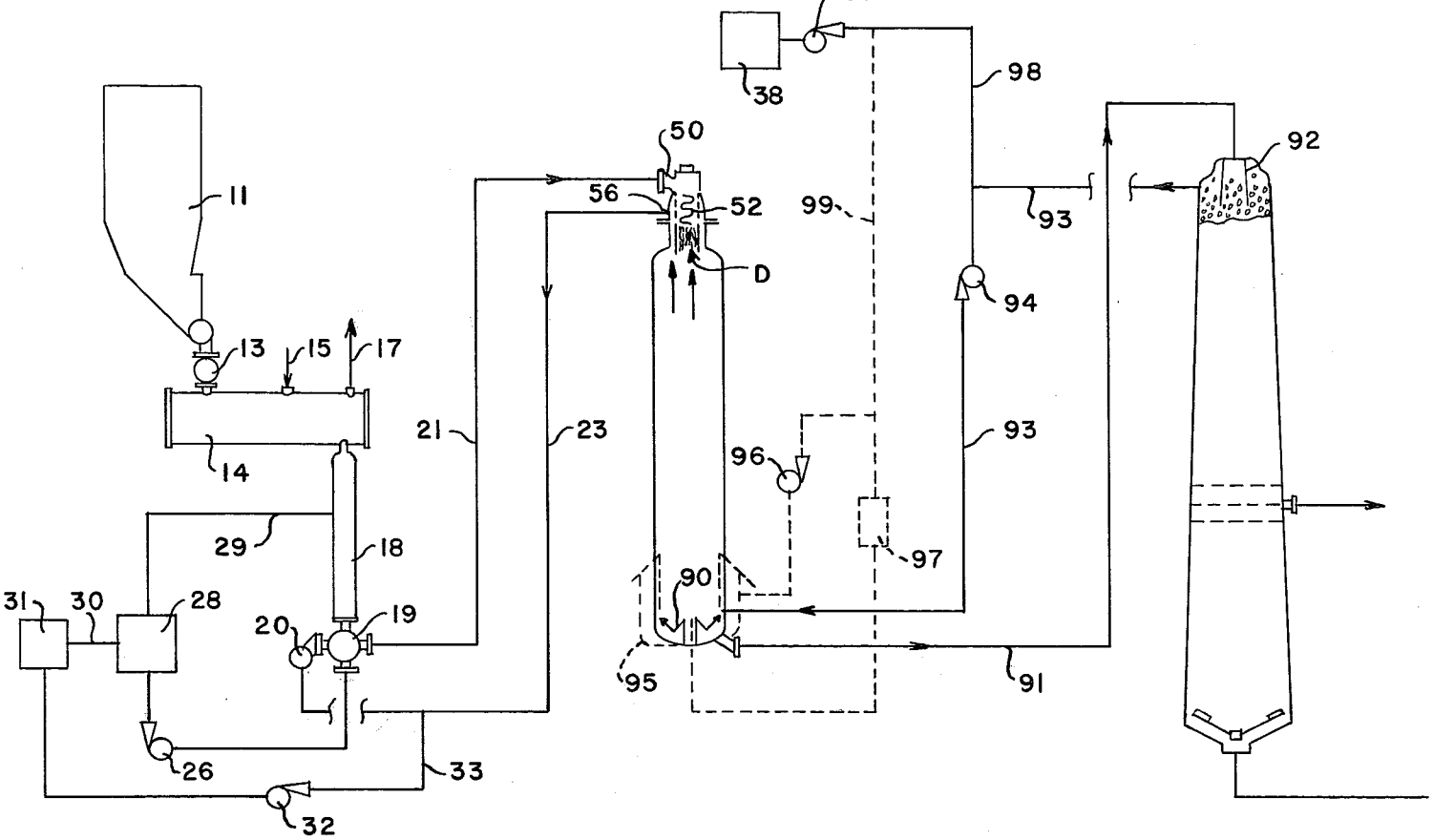
FIG. 2 is a schematic view of an exemplary two-vessel modification of apparatus according to the present invention.

While the apparatus according to the present invention may be utilized for a single vessel treatment of chips, as shown in FIG. 1, the apparatus according to the present invention is also useful with two or three-vessel treatment for the chips. An exemplary two-vessel system is shown in FIG. 2, the two-vessel system including a first, impregnation vessel 88, and a second, digesting vessel 89 hydraulically connected thereto. As shown in copending U.S. application, Ser. No. 701,037, filed June 29, 1976 by Michael I. Sherman and entitled "Three-Vessel Treatment System", a wash vessel may be connected up to the digesting vessel 89, if desired, or the vessel 89 may include both digestion and washing zones. A scraper 90 or the like is provided in the bottom of the first vessel 88 for feeding impregnated chips material through line 91, completely hydraulically, to inlet 92 for the second vessel 89. The inlet 92 may be arranged so as to provide for screenless withdrawal of liquid from the top of second vessel 89 via line 93 to be returned to the first vessel 88 and establish a countercurrent flow of digesting liquid therein. Line 94 provides the energy for the return of the liquid through line 93 to the first vessel 88 to be established in countercurrent flow therein, and fresh digesting liquid from source 38 may be supplied by pipe 39 through line 98 to the line 93 for establishment of the countercurrent flow in the first vessel 99. If desired, between vessel heating may also be provided, such as shown in copending application, Ser. No. 698,125, filed June 21, 1976, by Sherman and Prough and entitled "Two-Stage Digestion With Between Vessel Heating".

Also, if desired, the bottom of the first vessel 95 may be enlarged, and screenless withdrawal of liquid therefrom may be provided by pump 96, passing the withdrawn through pump 97 to be introduced into the vessel 88 to establish a countercurrent flow of digesting liquid in vessel 88, fresh digesting liquid being supplied via line 99 from source 38 (see dotted line representations in FIG. 2). Such structure is also more fully described in copending application, Ser. No. 698,125.

It will thus be seen that according to the present invention, a method and apparatus have been provided which result in greatly reduced energy demands, reduced scaling, increased methanol and turpentine recovery, and decreased chemical demand, as well as other results that are improved over the prior art. This is accomplished according to the present invention by the withdrawal of the displaced water and minerals from the chips being impregnated in the impregnation zone into the feed system, and the establishment of a chips plug in the top portion of the treatment vessel. While the invention has been herein shown and described in what is presently conceived to be the most practical and preferred embodiment, it will be apparent to those of ordinary skill in the art that many modifications thereof may be made within the scope of the present invention, which scope is to be accorded the broadest interpretation of the appended claims, so as to encompass all equivalent structures and devices.

What is claimed is:

1. Apparatus for treating cellulosic chips material comprising a. a high-pressure transfer valve for transporting cellulosic chips and liquid under pressure, b. a high-pressure vertical treatment vessel having at least an impregnation zone in an upper portion thereof, and a top chamber above the impregnation zone, c. a chips and liquid inlet to said top chamber of said vessel, d. a feed system for feeding chips and liquid to said inlet and for returning liquid from said inlet to said high-pressure transfer valve, said feed system including conduits extending from said top chamber to said transfer valve, e. means for establishing a countercurrent flow of digesting liquid in said impregnation zone of said vessel liquid, said means including means for withdrawing liquid from said impregnation zone through said top chamber of said vessel into said feed system, f. means for withdrawing liquid from said feed system; so that essentially no free water enters said vessel impregnation zone, g. means for withdrawing treated chips material from the bottom of said vessel, and h. means for establishing a chips plug in said vessel below said inlet for isolation of said top chamber of said vessel from the impregnation zone thereof, said means for withdrawing liquid from said impregnation zone through said top chamber of said vessel including an outlet disposed above said chips plug in the top chamber of said vessel.

2. Apparatus, as recited in claim 1, wherein said high-pressure vertical treatment vessel is a first, impregnation vessel, and further comprising a second liquid-filled vertical treatment vessel operatively hydraulically connected to said means for withdrawing chips material from the bottom of said first vessel.

3. Apparatus, as recited in claim 2, wherein said second vessel is a digesting and washing vessel, and further comprising means for feeding impregnated cellulosic chips material to the top portion thereof and withdrawing liquid therefrom without screens.

4. Apparatus, as recited in claim 1, wherein said means for establishing a chips plug for isolation of said topmost portion of said vessel from the impregnation zone thereof includes a screw-feeder rotatable about a vertical axis and surrounded by a tubular screen, said inlet being inside said tubular screen and said outlet being outside said tubular, screen, and a solid-wall generally tubular member extending downwardly from the bottom of said screw-feeder and said tubular screen for capturing chips therein and forming a chips plug.

5. Apparatus, as recited in claim 1, further comprising a source of digesting liquid operatively connected to said means for establishing a countercurrent flow of digesting liquid in the impregnation zone of said vessel, and further comprising means for feeding digesting liquid to an end portion of said high-pressure transfer valve for monitoring the pH thereof.

6. Apparatus, as recited in claim 1, further comprising means for withdrawing methanol from a line operatively connected to said liquid outlet from said vessel top chamber.

7. Apparatus, as recited in claim 1, further comprising a high-efficiency centrifuge for separating sand from a liquid in a line operatively connected to said high-pressure transfer valve.

8. Apparatus, as recited in claim 1, further comprising means for withdrawing turpentine from a line operatively connected to said liquid outlet from said vessel top chamber.

9. A method for treating cellulosic chips material utilizing high-pressure transfer valve connected by a feed system to at least one vertical treatment vessel having a top chamber, comprising the steps of continuously a. feeding chips material and liquid to the high-pressure transfer valve to boost the pressure thereof, b. transporting said high-pressure chips material and liquid to the top chamber of the vertical treatment vessel and introducing said chips into the top chamber of the vessel from the feed system, to establish a column of chips in the vessel below said top chamber of the vessel, c. establishing a countercurrent flow of digesting liquid in the vessel impregnation zone to displace water, calcium and other minerals from the chips material, while impregnating the chips material with digesting liquid, by withdrawing liquid from said impregnation zone through said top chamber of the vessel into the feed system, d. withdrawing liquid, including the displaced water, calcium, and other minerals, from the feed system; the withdrawals practiced in steps (c) and (d) insuring that essentially no free water enters the vessel impregnation zone, and e. withdrawing treated chips material from the bottom of the vessel.

10. A method, as recited in claim 9, wherein the vessel contains an impregnation zone, a digestion zone, and a washing zone, and comprising the further step of controlling the upflow in the digestion and impregnation zones by adjusting the withdrawl above the washing zone.

11. A method, as recited in claim 9, wherein two vessels are provided, the first vessel being an impregnation vessel and the second vessel being a liquid-filled cooking vessel, and comprising the further steps of entirely hydraulically feeding withdrawn treated chips material from the bottom of the first vessel to the top of the second vessel and withdrawing liquid from the top of the second vessel and returning it to the bottom of the first vessel to assist in establishing a countercurrent flow of digesting liquid in the first vessel.

12. A method, as recited in claim 9, comprising the further step of feeding digesting liquid in an end portion of the high-pressure transfer valve to maintain the pH of liquid thereat above 8.

13. A method, as recited in claim 9, comprising the further step of establishing a chips plug at the top chamber of the vessel below the withdrawal point of liquid from the impregnation zone and below the inlet of chips to the vessel for isolation of the top chamber of the vessel from the impregnation zone.

14. A method, as recited in claim 9, comprising the further steps of separating turpentine and methanol from the liquid withdrawn from the top chamber of the vessel.

15. A method, as recited in claim 9, comprising the further step of withdrawing sand from liquid in a line operatively connected to the high-pressure transfer valve by high-efficiency centrifuging thereof.

* * * * *